United States Patent [19]

Kaiser et al.

[11] Patent Number: 4,815,672

[45] Date of Patent: Mar. 28, 1989

[54] TOROIDAL CORE COIL WINDING APPLIANCE

[75] Inventors: Jurgen Kaiser, Regensburg; Rudolf Kerler, Pielmuehle, both of Fed. Rep. of Germany

[73] Assignee: Siemens Aktiengesellschaft, Berlin and Munich, Fed. Rep. of Germany

[21] Appl. No.: 27,438

[22] Filed: Mar. 18, 1987

[30] Foreign Application Priority Data

Apr. 17, 1986 [DE] Fed. Rep. of Germany ..... 3613019

[51] Int. Cl.[4] ..... H01F 41/06

[52] U.S. Cl. ..... 242/4 R; 226/172

[58] Field of Search ..... 242/4 R, 4 A, 5; 226/172, 173

[56] References Cited

U.S. PATENT DOCUMENTS

| | | | |
|---|---|---|---|
| 751,816 | 2/1904 | Strong | 242/5 |
| 2,102,692 | 12/1937 | Franz | 242/4 R |
| 3,132,816 | 5/1964 | Oshima | 242/4 R |
| 3,368,726 | 2/1968 | Gudmestad | 226/172 |
| 3,599,884 | 8/1971 | Tillman | 242/4 R |
| 3,732,901 | 5/1973 | Kent et al. | 242/4 R |
| 3,811,629 | 5/1974 | Sedgewick | 242/4 A |
| 4,288,041 | 9/1981 | Marzec et al. | 242/4 R |

FOREIGN PATENT DOCUMENTS

| | | |
|---|---|---|
| 1263183 | 3/1968 | Fed. Rep. of Germany . |
| 1514191 | 9/1970 | Fed. Rep. of Germany . |

*Primary Examiner*—Stanley N. Gilreath
*Assistant Examiner*—Katherine Matecki
*Attorney, Agent, or Firm*—Hill, Van Santen, Steadman & Simpson

[57] ABSTRACT

A toroidal core coil winding appliance is provided including a toroidal core mount, a wire feed and a conveyor means for shaping and turning wire loops through the toroidal core opening which further includes at least two stationary conveyor sheaves and a plurality of deflection rollers whose rotational axes are arranged parallel to one another and preferably perpendicular to the rotational axis of the toroidal core. Flexible conveyor belts are guided on the conveyor sheaves with the assistance of the deflection rollers, these flexible conveyor belts being pressed against one another over longer sections of the wire loop paths. The wire loops are clamped between the conveyor belts and are drawn through the toroidal core openings. After the acceptance of a defined wire length in the conveyor means, the wire feed is stopped and, at the same time, the clamped wire end is deflected out of the conveying plane of the wire loop.

8 Claims, 3 Drawing Sheets

TOROIDAL CORE COIL WINDING APPLIANCE

BACKGROUND OF THE INVENTION

1. Field of the Invention

The invention is directed to a toroidal core coil winding appliance including a torodial core mount for rotatably seated toroidal cores, including a wire feed, a fixing element for the interruption of the wire feed and including conveying means for forming and conveying wire loops through the toroidal core opening.

2. Description of the Prior Art

Such a winding appliance is disclosed by U.S. Pat. No. 3,732,901 wherein wire is hauled off from a wire reel, is conveyed to a flat conveying means via a wire feed, the supplied wire is shaped therein to form a flat helix or spiral and every wire turn is thereby drawn through the toroidal core opening. After the feed of a defined wire length, the conveying means fixes the wire end. Due to the continued rotation of the wire helix, finally, the wire is tensed, rolled off via a wire brake and is uniformly wound around the toroidal core.

The shaping of the wire to form a flat helix and its exact transport through the toroidal core opening make high demands of the precision of the conveying means. For shaping the helices, the wire must be pre-bent within the wire feed and must be further conveyed and shaped in the conveying means by conical conveyor drums. Since every new wire turn has a smaller radius than the preceding wire turn given a flat helix, the conveyor drums must be designed such that they taken the different circumference of every individual wire turn into consideration. A non-uniform force transmission onto the wire turns, namely, leads to the divergence or, respectively, to the interlacing of the wire turns.

Over and above this, the wire turns between the conveying drums must be held on a circular path by means of special guide auxiliaries. The appliance of U.S. Pat. No. 3,732,901 employs a special guide channel for this purpose, the width thereof having to be adapted to the respective wire thicknesses. At the same time, the wire brake must be reset to every new wire thickness and wire stiffness.

Toroidal core coil winding appliances comprising a movable magazine are also known, i.e., in particular, annular, rotating magazine having an orbit conducted through the toroidal core opening. Here, the wire is coiled onto the magazine in a prescribed length and is conducted through the toroidal core opening together with the magazine. However, winding appliances comprising a magazine are unsuitable for winding toroidal cores having extremely small residual openings since the size of the residual hole is limited by the shape of the magazine.

SUMMARY OF THE INVENTION

An object of the present invention is to structurally improve the winding appliance of the type described above; in particular, this winding appliance should enable an economical, largely automatic winding of toroidal cores down to the smallest residual openings on the order of magnitude of the diameter of a wire, whereby relatively great wire lengths should also be processable and high numbers of turns should be obtainable.

In order to achieve this object, the invention provides a conveying means including at least two stationary conveyor sheaves drivable in the same direction which rotate in the plane of the wire loop path and, with the assistance of a plurality of deflection rollers preferably arranged axially parallel to one another and to the conveying sheaves, each entrain a conveyor belt pair sectionally along the wire loop path and press them against one another; the invention also provides an excursion device by means of which the last wire loop supplied can be deflected out of the wire loop path.

An exact shaping and reliable guidance of the wire loops through the toroidal core opening is possible with the assistance of the conveyor belt conveying wherein the wires are clamped between the conveyor belts of the individual conveyor belt pairs. All wire loops can be conveyed with the same angular speed without giving rise to the risk of divergency or interlacing. A special wire brake is not necessary since the wire is necessarily deformed somewhat when pulled off from the conveyor device. Changing to a different wire thickness is also unproblemmatically possible. The flexible conveyor belts can easily adapt to different wire thicknesses. The excursion of the clamped wire portion can advantageously ensue on the basis of the clamping means itself.

When winding the toroidal core around a larger winding region, it is thereby expedient to entrain the wire end clamped in the clamp device with the rotational movement of the toroidal core. However, it is also possible to swivel the wire end parallel to the rotational axis of the toroidal core and to fix it there until the end of the winding process.

By simply adjusting individual deflection rollers, finally, the conveyor belt tension and, thus, the winding pull are infinitely adjustable.

BRIEF DESCRIPTION OF THE DRAWNGS

The subject matter of the invention shall be set forth in greater detail with reference to an exemplary embodiment. Shown are:

DESCRIPTION OF THE PREFERRED EMBODIMENTS

Figure 1:
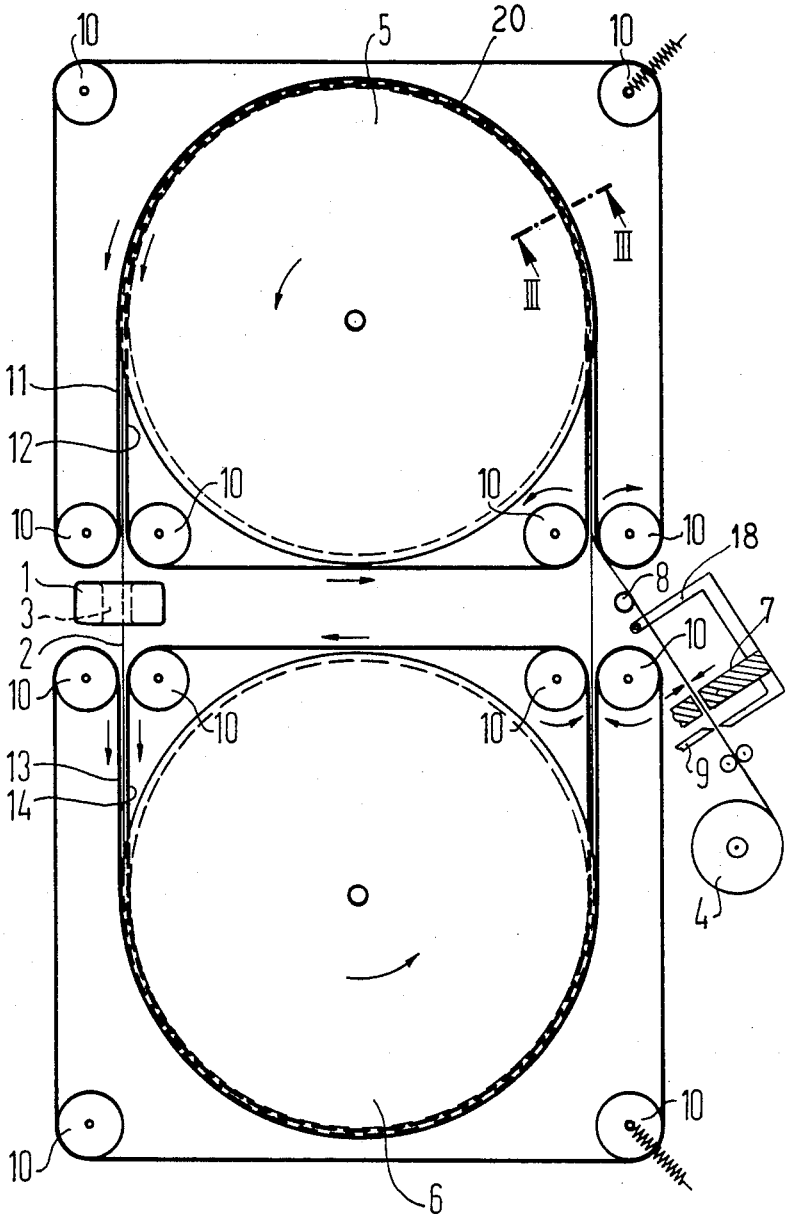
FIG. 1 is a plan view and schematic illustration of a toroidal core coil winding appliance of the invention in the wire feed position.

The winding appliance of FIG. 1 includes a toroidal core 1, a conveyor means for wire loops 2 and a wire feed composed of a clamp means 7, a cutting means 9, a supply reel 4 and a deflection rod 8. The conveying means includes two large conveyor sheaves 5, 6 and a plurality of smaller deflection rollers 10. Two conveyor belt pairs 11, 12 or, respectively, 13, 14 are moved on the conveyor sheaves and deflection rollers in the direction indicated by arrows.

For loading the conveyor means, the wire start is advanced by the wire feed and is picked up by the conveyor belt pair 11, 12, is deflected and thrust through the toroidal core opening 3. Subsequently, the wire start is guided farther by the conveyor belt pair 13, 14 and is in turn handed over to the conveyor belt pair 11, 12. After feed of a preselected wire length, the clamp means 7 stops the further wire feed. At the same time, the clamped wire end is deflected out of the conveying plane of the wire loops under the influence of an excursion device which is merely suggested in the drawing at 18, but which is structurally well-known in the form of a lever, which, upon actuation of the excursion means, is lifted vertically up, as seen in the plane of the drawing, to thereby lift the wire off from the conveying sheave 5. Due to the winding pull of the continuing conveyor belts 11, 12, 13, 14, the wire is pulled out of the belt pair 11, 12 and is placed around the toroidal core as a loop. The winding pull can be varied by changing the belt tension. To this end, the deflection rollers 10 of the outer conveyor belts 11, 13 can preferably be tensed perpendicular to their rotational axes by spring forces.

The conveyor means can be loaded both left-handed as well as right-handed. Given right-handed operation, the wire feed is pivoted and the wire start is initially picked up by the conveyor belt pair 13, 14, is thrust through the toroidal core opening 3 and handed over to the conveyor belt pair 11, 12. Over and above this, winding with two and more wires is also simultaneously possible. To this end, the wires are suplied from separate wire feeds (not shown) and are coiled in the conveyor means in the form of loops lying side-by-side. The stopping of the wire ends and pull-off ensue simultaneously for all wires.

Figure 2:
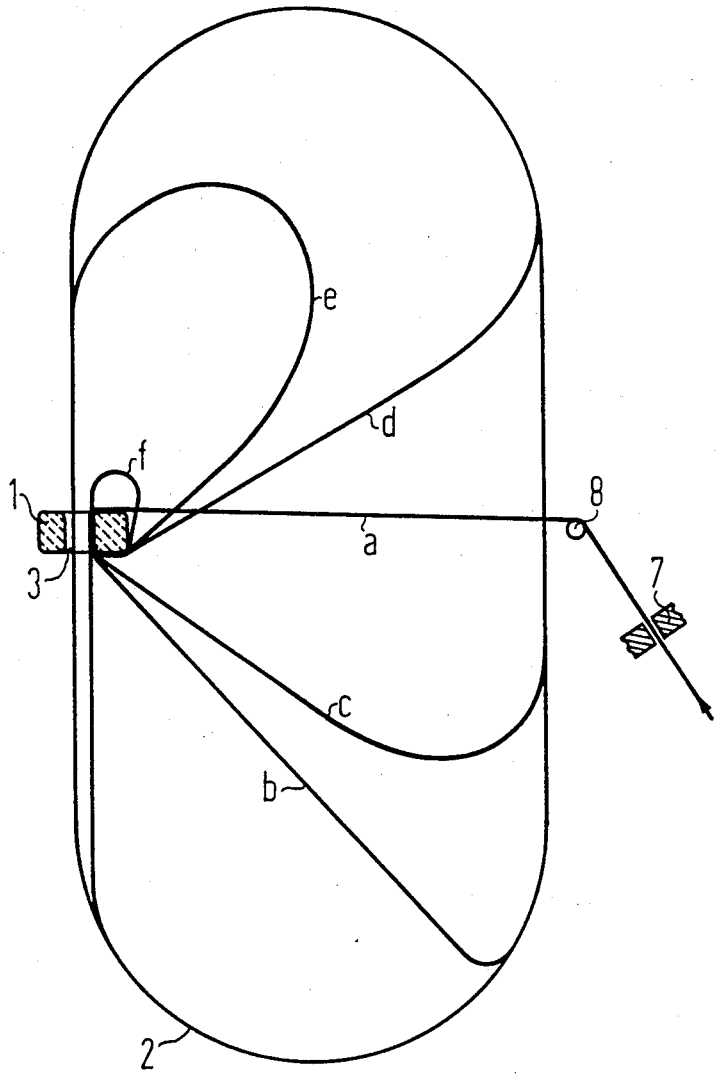
FIG. 2 illustrates a plurality of shapes of wire loops during winding.

FIG. 2 shows a number of snapshots of loops in chronological succession from a through f. For greater clarity, the component part of the conveyor means are thereby omitted in this FIG. First, the deflected wire piece tenses between the deflection rod 8 and the toroidal core 1 (position a). Given continued belt transport, the loop shapes b, c, d, e and f derive at specific times.

Figure 3:
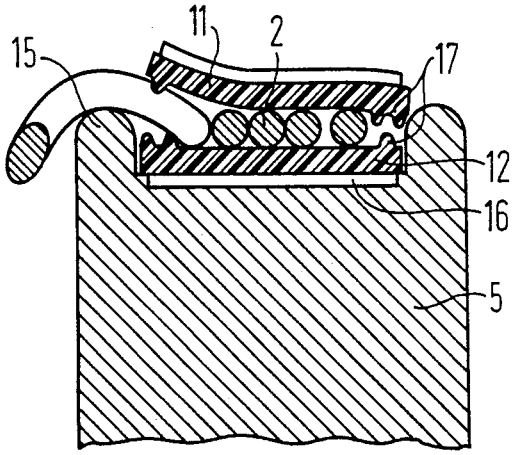
FIG. 3 is a section taken generally along line III—III in FIG. 1 through a conveyor belt pair in an enlarged scale.

FIG. 3, finally, shows a section through the conveyor belt pair 11, 12 and through the conveying sheave 5 at the point in time of the wire haul-off. Five wire loops 2 are conveyed between the conveyor belt pair 11, 12. Due to the winding pull, the wire loop shown at the left in the plane of the drawing is pulled off out of the conveyor means via the lateral flange 15 of the conveyor sheave 5. The conveyor belts 11, 12 are executed as toothed belts. The conveyor sheave 5 is provided with a gear rim 16 mating thereto is that the gear rim has teeth 20 as seen in FIG. 1 which mesh with teeth of the tooth belts. The conveyor belts 11, 12 include small guides 17 in their edge regions which enable an easy guidance of the wire loops 2 and of the conveyor belts 11, 12. Conveyor belts 13, 14 and conveyor sheave 6 are formed identical to conveyor belts 11, 12 and conveyor sheave 5, respectively, with respect to the teeth on the belts and sheave and with respect to the guides on the belts.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. A toroidal core coil winding appliance comprising a toroidal core mount for rotatably seated toroidal cores, a wire feed which includes a supply of wire to be directed toward said toroidal core, a fixing element for interrupting the wire feed, and an excursion device, the appliance further comprising a conveyor means for shaping and conveying wire loops in a planar loop path through a toroidal core opening, said conveyor means including a plurality of deflection rollers and at least two stationary conveying sheaves drivable in the same direction which rotate in the plane of the wire loop path and which, with said plurality of deflection rollers, each entrain a conveyor belt pair sectionally along the wire loop path, the conveying sheaves and deflecting rollers acting to press the belts of said belt pair against one another; whereby the excursion device deflects a last wire loop supplied out of the plane of the wire loop path.

2. The toroidal core coil winding appliance according to claim 1, wherein the fixing element is a clamp device.

3. A toroidal core coil winding apparatus according to claim 1, wherein the wire feed further includes a cutting means for cutting the wire to length.

4. A toroidal core coil winding appliance according to claim 3, including at least one supply reel providing said supply of wire, said fixing element being located between said supply reel and said conveying sheaves.

5. A toroidal core coil winding appliance according to claim 1, wherein the conveyor belts of the conveyor belt pairs are fashioned as toothed belts; and in that the conveying sheaves contain a gear rim having teeth which mesh with the teeth of the conveyor belts.

6. A toroidal core coil winding appliance according to claim 1, wherein the conveyor belts include guide means in the edge regions of their wire-conducting sides.

7. A toroidal core coil winding appliance according to claim 1, wherein tensing elements are provided at individual deflection rollers for setting the conveyor belt tension.

8. A toroidal core coil winding appliance according to claim 1, wherein a cutting means for cutting the wire to length is positioned between said fixing element and said supply of wire.

* * * * *